US005153555A

United States Patent [19]

Enomoto et al.

[11] Patent Number: 5,153,555

[45] Date of Patent: Oct. 6, 1992

[54] ELECTRONIC DEVICE COMPRISING A PLATE-SHAPED ELECTRONIC ELEMENT AND A SUPPORT AND OVERCURRENT PROTECTOR FOR THE SAME

[75] Inventors: Hisao Enomoto; Takayo Katsuki, both of Kyoto, Japan

[73] Assignee: Murata Manufacturing Co., Ltd., Japan

[21] Appl. No.: 619,038

[22] Filed: Nov. 28, 1990

[30] Foreign Application Priority Data

Nov. 28, 1989 [JP] Japan ..... 1-137764

[51] Int. Cl.[5] ..... H01C 7/10; H01C 10/14

[52] U.S. Cl. ..... 338/22 R; 338/226; 338/234; 338/276; 338/318; 361/106

[58] Field of Search ..... 338/22 R, 225 D, 226, 338/234, 276, 315, 318; 361/104, 106, 27, 165

[56] References Cited

U.S. PATENT DOCUMENTS

| | | | |
|---|---|---|---|
| 3,750,082 | 7/1973 | Petersen et al. | 338/220 |
| 3,842,188 | 10/1974 | Petersen | 174/52 R |
| 3,988,709 | 10/1976 | McKinnon et al. | 338/57 |
| 4,241,370 | 12/1980 | De Fillipis et al. | 361/24 |
| 4,635,026 | 1/1987 | Takeuchi | 338/225 D |

FOREIGN PATENT DOCUMENTS 123301 8/1984 Japan .

*Primary Examiner*—Marvin M. Lateef

*Attorney, Agent, or Firm*—Ostrolenk, Faber, Gerb & Soffen

[57] ABSTRACT

There is disclosed an electronic device comprising a plate-shaped electronic element having electrode films. The electronic element is elastically supported by spring members in an electrically insulating case so as to be respectively in contact with the electrode films. Each spring member includes supporting plates opposing to the electrode films and spring pieces for being respectively in contact with the electrode films at contact points thereof. Each spring piece is formed integrally with the supporting plate so as to be extended with a curvature toward the electrode film from one end of the supporting plate in the longitudinal direction thereof to the contact point, to be folded by a predetermined angle at the contact point, and to be further extended toward the supporting plate from the contact point without contact with the supporting plate. Further, each spring piece has a predetermined thickness and a predetermined width so as to be cut when a current flowing in the spring pieces through the electronic element becomes larger than a predetermined threshold current in an abnormal state of the electronic element.

18 Claims, 6 Drawing Sheets

ELECTRONIC DEVICE COMPRISING A PLATE-SHAPED ELECTRONIC ELEMENT AND A SUPPORT AND OVERCURRENT PROTECTOR FOR THE SAME

BACKGROUND OF THE INVENTION

1. Field of the Invention

The present invention relates to an electronic device for providign protection from excessive current, and more particularly, to an electronic device serving as a support for an electronic element while also providing interrupt protection against excessive current flow.

2. Description of the Related Art

As one example of a conventional electronic device of this type, a thermistor device 1 which is used in a non-contact type starter for a compressor of a refrigerator is shown in FIG. 7.

Referring to FIG. 7, the thermistor device 1 comprises a disc-shaped thermistor 5 having a positive temperature coefficient (referred to as a PTC thermistor hereinafter), on both main surfaces of which, electrode films 4 are formed. In an outer packaging case 2 of a synthetic resin of the thermistor device 1, the PTC thermistor 5 is elastically supported between a pair of spring members 3, a respective one of which is in contact with each of the electrode films 4 of the thermistor 5, wherein each spring member 3 is formed by punching an elastic metal plate.

Referring to FIG. 8, each of the spring members 3 comprises a pair of V-shaped plate springs 6, wherein the center portions of the respective plate springs 6 are connected through a bridge portion 7 and both ends of the respective plate springs 6 are connected through respective bridge portions 8. Each spring member 3 is fixed on a tab-shaped connection terminal 9 so that the bridge portion 7 thereof is connected thereon by the spot welding method. A pair of connection terminals 9 are fixed on respective inner side surfaces 11 of the outer packaging case 2 which oppose each other. Both the electrode films 4 of the PTC thermistor 5 are pressed by both ends of both respecti,ve plate springs 6 of a pair of spring members 3, whereby the PTC thermistor 5 is elastically supported by the pair of spring members 3.

In the conventional thermistor device 1, if the PTC thermistor 5 starts a thermal runaway caused by an application of an abnormally high voltage or at the end of the life thereof, the current flowing through the PTC thermistor 5 increases steeply. Even in this case, since the connection terminal 9 and the spring member 3 have large current capacities, respectively, the electricity is supplied to the PTC thermistor 5 until the PTC thermistor 5 has been completely destroyed. In this case, the temperature of the thermistor device 1 increases up to about 1000° C., and in the worst case, the thermistor device 1 may cath fire.

In order to solve the above-mentioned problems of the conventional thermistor device 1, for example, as shown in FIGS. 7 and 8, there has been proposed a thermistor device 1' having a spring member 3a which further comprises a plate portion 14 to be fixed on the connection terminal 9 by the spot welding method and a connection portion 15 for connecting the bridge portion 7 with the plate portion 14, in addition to a pair of plate springs 8 and the bridge portions 7 and 8 (See the Japanese utility model laid open publication (JP-U) No. 59-123301/1984), wherein the connection portion 15 has a width smaller than that of the plate portion 14.

In, the thermistor device 1', when the current flowing through the PTC thermistor 5 becomes larger than a predetermined threshold current after a thermal runaway is caused in the PTC thermistor 5, the connection portion 15 having the small width is fused (i.e., melted and/or cut). Therefore, the temperature of the PTC thermistor 5 can be prevented from becoming higher than a predetermined abnormal threshold temperature thereof.

However, if the connection portion 15 of the conventional thermistor device 1' shown in FIG. 9 has too small a width or too small a thickness, the connection portion 15 may be easily broken or be easily cut when an impact is applied thereto upon connecting the thermistor 1' with another device or a terminal of a printed circuit board. Therefore, it is necessary for the connection portion 15 to have a width larger than a predetermined necessary width and a thickness larger than a predetermined necessary thickness. Accordingly, it is necessary for the spring member 3a to have a relatively large current capacity. In this case, if a thermal runaway is caused in the PTC thermistor 5, it takes a long time to fuse the connection portion 15, resulting in the problem that the outer packaging case 2, etc., may be thermall damaged or destroyed.

SUMMARY OF THE INVENTION

Therefore, an important object of the present invention is to provide an electronic device comprising an elastically supported electronic element, capable of interrupting the supply of the electricity to the electronic element when the current flowing in the electronic element becomes larger than a predetermined threshold current in an abnormal state thereof.

Another object of the present invention is to provide an electronic device comprising an elastically supported element, capable of preventing components thereof from being thermally damaged when the current flowing in the electronic element becomes larger than a predetermined threshold current in an abnormal state thereof.

In order to accomplish the above objects, according to one aspect of the present invention, there is provided an electronic device comprising:

a plate-shaped electronic element having electrode films formed on main surfaces thereof;

spring members for elastically supporting said electronic element therebetween in an electrically insulating case so as to be respectively in contact with said electrode films of said electronic element, each spring member being made of an elastic metal plate; and connection terminals for electrically connecting said spring members with external circuits, respectively, said connection terminals being fixed in said case and being electrically connected with said spring members, respectively, each of said spring members comprising:

supporting plates opposing to said electrode films of said electronic element, each of said supporting plates having a predetermined longitudinal length and a predetermined width; and spring pieces for being respectively in contact with said electrode films of said electronic element at contact points thereof, each of said spring pieces being formed integrally with said supporting plate so as to be extended with a curvature toward said electrode film of said electronic element from one end of said supporting plate in the longitudinal direction thereof to said contact point, to be folded by a predetermined angle at said contact point, and to be further extended with another curvature toward said supporting plate from said contact point without contact with said supporting plate, each of said spring pieces having a predetermined thickness and a predetermined width so as to be fused when a current flowing in said spring pieces through said electronic element becomes larger than a predetermined threshold current in an abnormal state of said electronic element.

According to another aspect of the present invention, said electronic device further comprises tab members for connecting said connection terminals with said spring members, respectively, each of said tab members having a cut portion formed therein.

According to a further aspect of the present invention, in the above-mentioned electronic device, each of said spring pieces has a predetermined thickness smaller than 0.25 mm and a predetermined width smaller than 2.0 mm.

According to a still further aspect of the present invention, in the above-mentioned electronic device, said electronic element is a thermistor having a positive

BRIEF DESCRIPTION OF THE DRAWINGS

These and other objects and features of the present invention will become clear from the following description of a preferred embodiment thereof, with reference to the accompanying drawings, in which.

DETAILED DESCRIPTION OF THE PREFERRED EMBODIMENT

A preferred embodiment according to the present invention will be described below with reference to the attached drawings.

Figure 1:
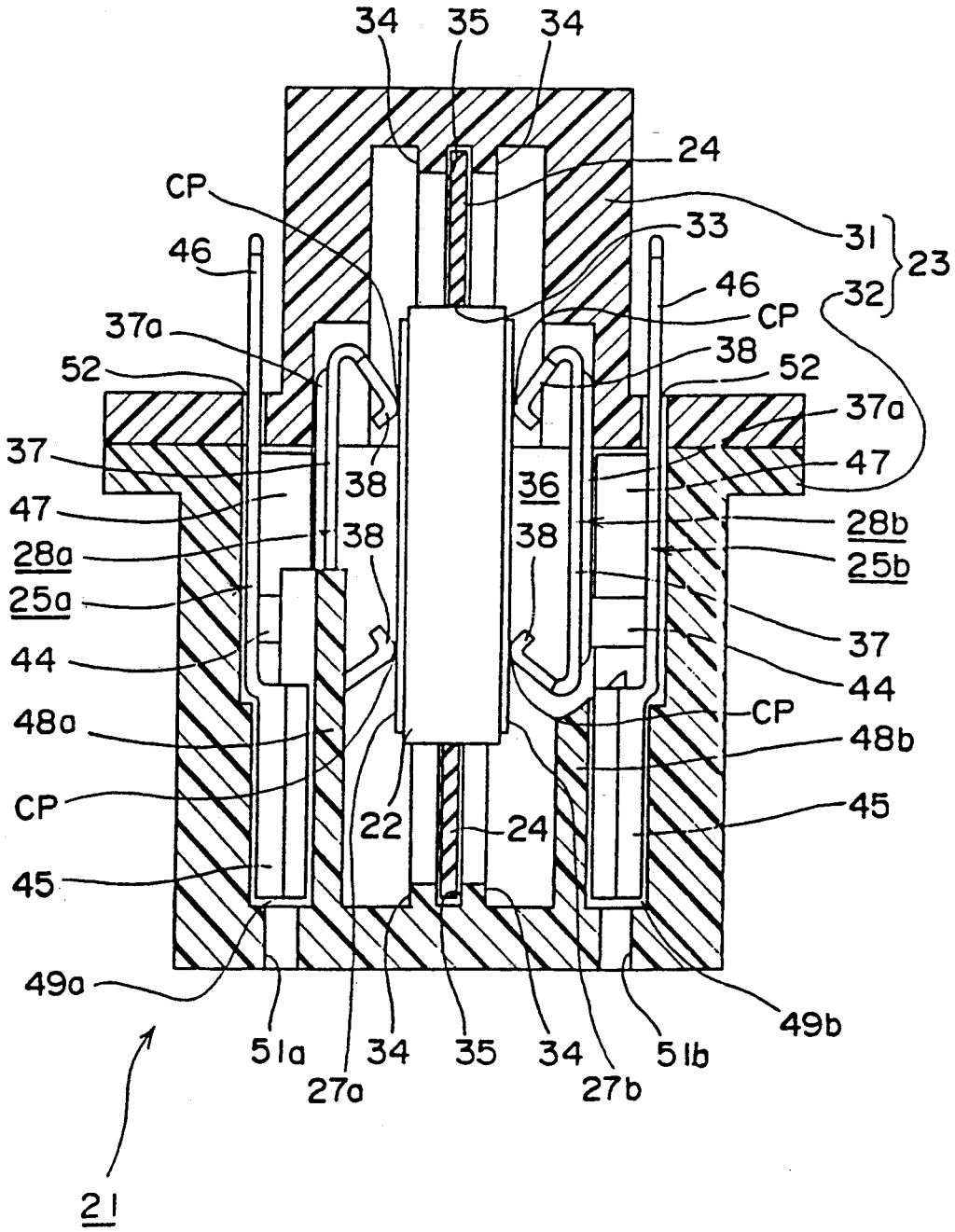
FIG. 1 is a partially broken longitudinal cross sectional view of a thermistor device comprising a PTC thermistor of a preferred embodiment according to the present invention.

FIG. 1 is a longitudinal cross sectional view showing a thermistor device 21 which is used in a non-contact type starter of a compressor of a refrigerator.

Referring to FIG. 1, the thermistor device 21 comprises a disc-shaped PTC thermistor 22, an outer packaging case 23, a supporting member 24 for supporting the PTC thermistor 22 in the outer packaging case 23, a pair of connection terminals 25*a* and 25*b* for supplying the electricity from an external circuit to the PTC thermistor 22, and a pair of spring members 28*a* and 28*b* for electrically connecting the connection terminal 25*a* with an electrode film 27*a* of the PTC thermistor 22 and electrically connecting the connection terminal 25*b* with an electrode film 27*b* thereof.

The PTC thermistor 22 is made of a ceramic material having a positive temperature coefficient, and the electrode films 27*a* and 27*b* are respectively formed on both the main surfaces of the PTC thermistor 22, which oppose to each other.

Figure 2:
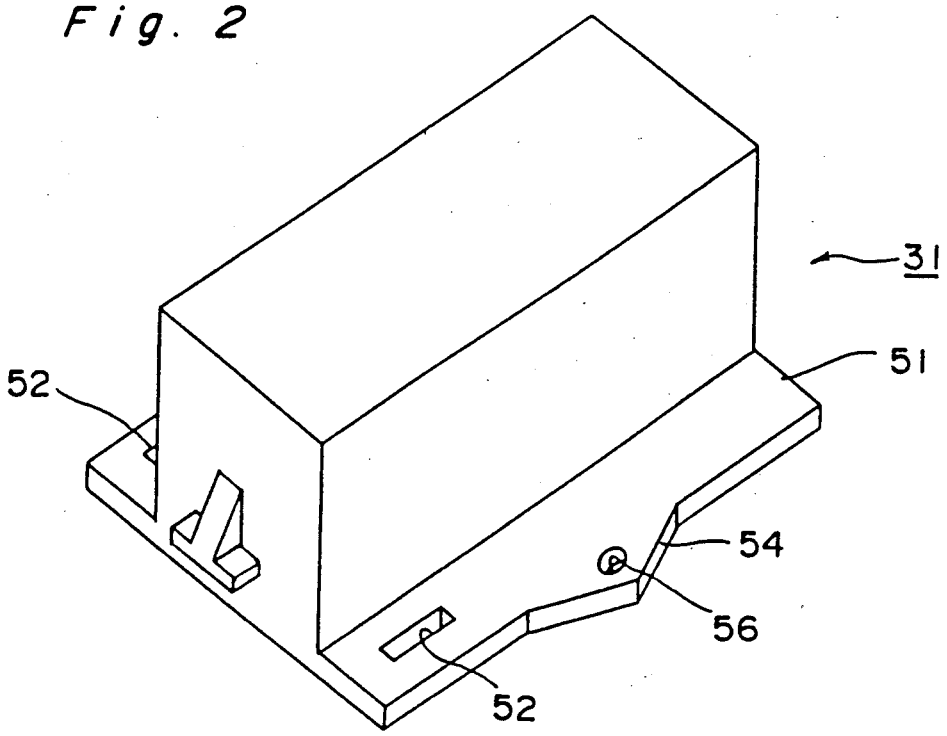
FIG. 2 is a perspective view of an upper case of the thermistor device shown in FIG. 1.
Figure 3:
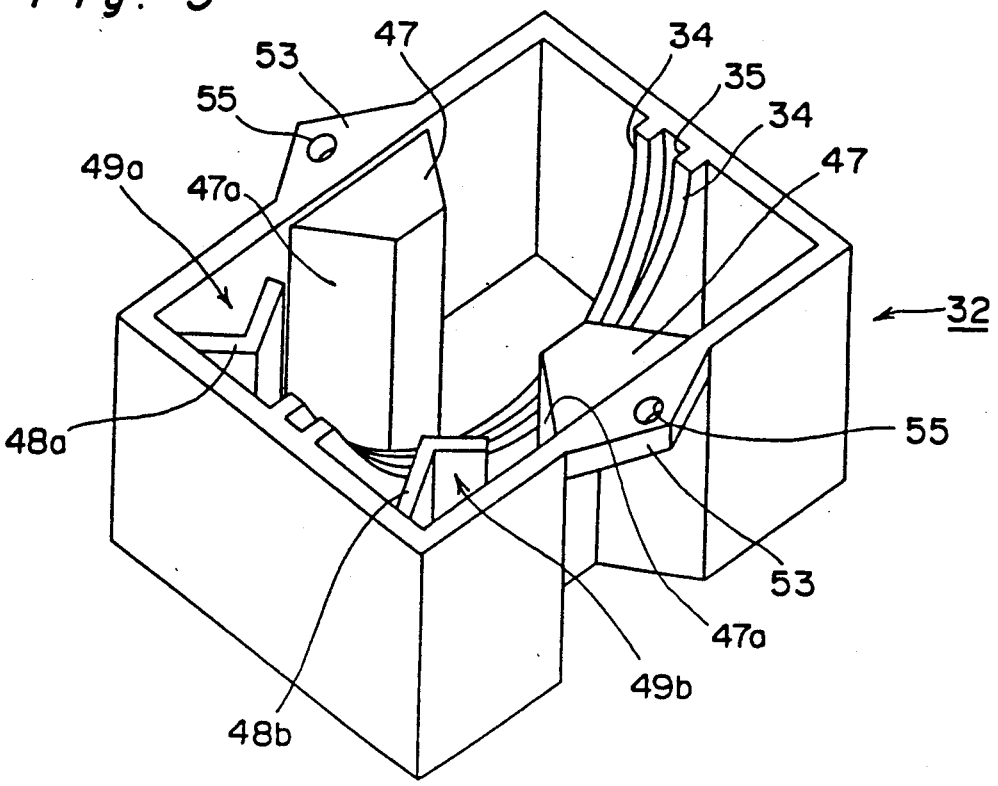
FIG. 3 is a perspective view of a lower case of the thermistor device shown in FIG. 1.

The outer packaging case 23 for accommodating the PTC thermistor 22, the supporting member 24, a pair of spring members 28*a* and 28*b* and the connection terminals 25*a* and 25*b* therein is composed of an upper case 31 shown in FIG. 2 and a lower case 32 shown in FIG. 3. Each of the upper and lower cases 31 and 32 is made of a synthetic resin having an electrically insulating property, and has a shape of an approximately rectangular parallelpiped box having an opening at one end thereof. On the inner wall fo each of the upper and lower cases 31 and 32, there are formed a pair of projections 34 in parallel to each other so as to form a channel 35 for mounting the supporting member 24 between a pair of projections 34.

After the PTC thermistor 22, the supporting member 24, a pair of spring members 28*a* and 28*b* and the connection terminals 25*a* and 25*b* are mounted in the outer packaging case 23 composed of the upper and lower cases 31 and 32, respective opening ends of the upper and lower cases 31 and 32 are bonded with a bonding agent to be fitted with each other. Upon being so fitted, a hole 56 formed in a projection portion 54 of upper case 31 which projects from a flange portion 51 thereof, becomes positioned directly over a hole 55 formed in a projection portion 53 of the lower case 32. At the same time, another hole 56 formed in another projection portion of upper case 31 that projects from another flange portion thereof (these elements all being on the opposite side of case 31 and therefore not visible in FIG. 2), becomes positioned directly over another hole 55 formed in another projection portion 53 of the lower case 32 on the side opposite to the first identified hole 55 and projection portion 53. The upper and lower cases 31 and 32 are fixed to each other by locking screws (not shown) which are inserted into the holes 55 and 56.

The supporting member 24 for supporting the PTC thermistor 22 in the outer packaging case 23 is composed of a disc plate of a material having an electrically insulating property and a heat proof characteristic such as mica, whereina hole 33 for mounting the PTC thermistor 22 therein is formed on the inner side of the disc plate. After the PTC thermistor 22 is mounted in the hole 33 so as to be supported, the outer peripheral end of the supporting member 24 is mounted in the channel 35 so as to be fixed.

Then, the PTC thermistor 22 is supported in approximately the center of a space 36 which is formed by respective inner walls of the upper and lower cases 31 and 32. It is to be noted that the spring member 28*a* is elastically in contact with the electrode film 27*a* of the PTC thermistor 22, and the spring member 28*b* is elastically in contact with the electrode film 27*b* thereof.

Figure 4:
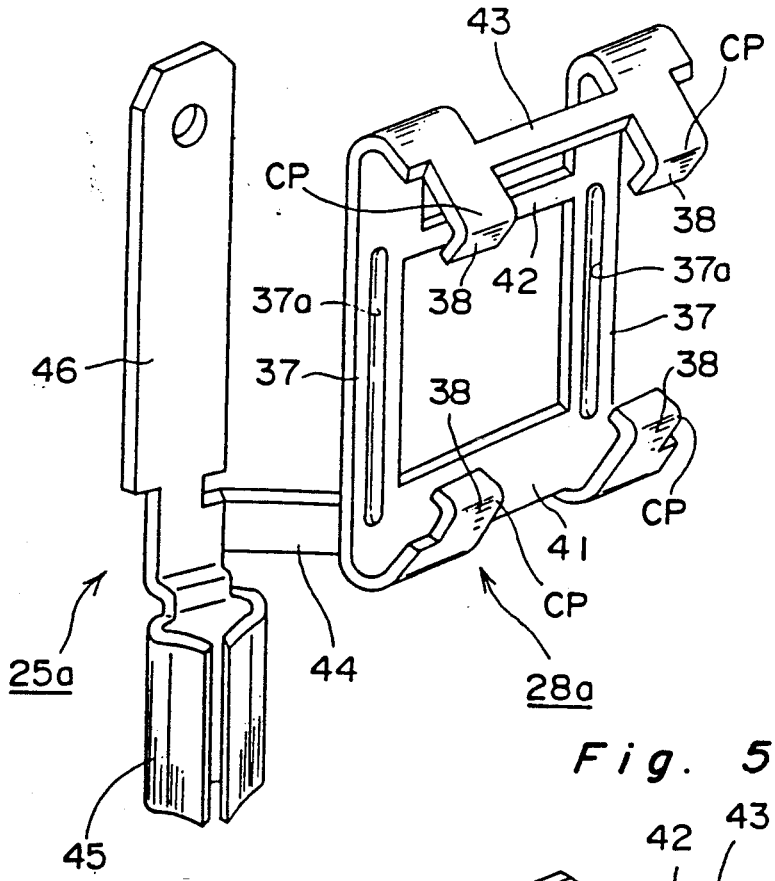
FIG. 4 is a perspective view of a connection terminal and a spring member fixed on the connection terminal of the thermistor device shown in FIG. 1.
Figure 5:
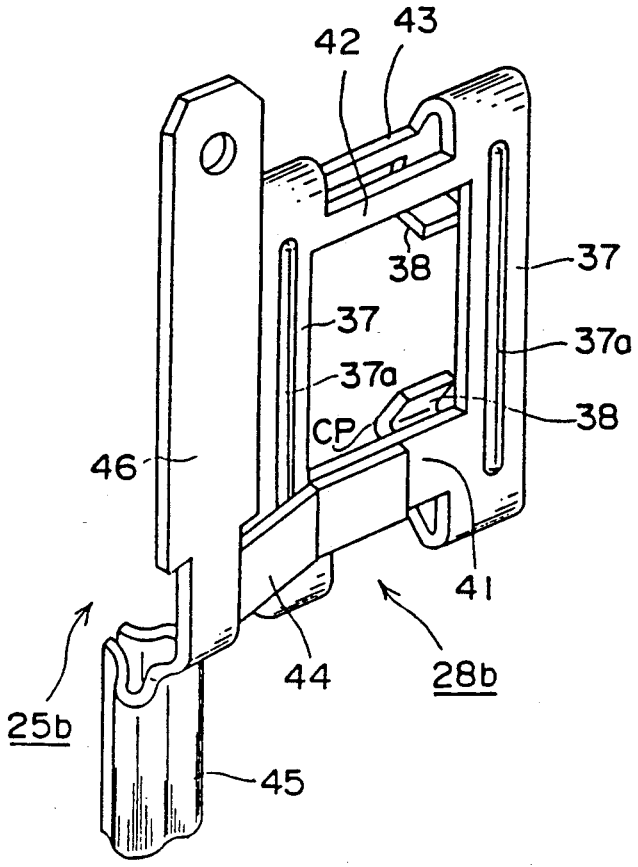
FIG. 5 is a perspective view of another connection terminal and another spring member fixed on another connection terminal of the thermistor device shown in FIG. 1.

FIG. 4 shows the spring member 28*a* and the connection terminal 25*a*, and FIG. 5 shows the spring member 28*b* and the connection terminal 25*b*. In FIGS. 4 and 5, the components corresponding to each other are denoted by the same numerals.

Referring to FIGS. 4 and 5, each of a pair of spring members 28*a* and 28*b* has a symmetrical shape with respect to the supporting member 24 shown in FIG. 1 for supporting the PTC thermistor 22. Each of a pair of spring members 28*a* and 28*b* is made of an elastic metal material such as a Cu-Ti alloy, stainless, and is integrally formed by punching a plate of the elastic metal material. Each of a pair of spring members 28*a* and 28*b* comprises a pair of supporting plates 37 to be opposed to the electrode films 27*a* or 27*b* of the PTC thermistor 22, each supporting plate 37 having a predetermined width and a longitudinal length in a vertical direction.

Each of a pair of spring members 28*a* and 28*b* further comprises four spring pieces 38 for being, respectively, in contact with the electrode film 27*a* or 27*b* at contact points CP upon mounting them in the upper and lower cases 31 and 32. Each of the spring pieces 38 is formed integrally with each supporting plate 37 so as to be extended with a curvature toward the electrode film 27*a* or 27*b* from one end of each supporting plate 37 in the longitudinal direction thereof to the contact point CP. Spring pieces 38 are folded or curved by a predetermined angle at the contact point CP, and are thereafter further extended toward each supporting plate 37 from the contact point CP without contact with each supporting plate 37. Further, each supporting plate 37 has a rib 37*a* having a longitudinal length in a direction perpendicular to the direction of the width thereof which is formed by the extruding formation method in order to increase the rigidity thereof.

The two supporting plates comprising the pair of supporting plates 37 in each spring member are connected with each other through three connection bridges 41 to 43 which are positioned at predetermined spaces smaller than the radius of the electrode film 27 of the PTC thermistor 22. Further, each of the pair of spring pieces 38 has a predetermined thickness and a predetermined width which are set so that each spring piece 38 is melted and cut or fused when a current flowing in the spring piece 38 through the PTC thermistor 22 becomes larger than a predetermined threshold current in an abnormal state of the PTC thermistor 22.

The outer surface of the connection bridge 41 of the spring member 28*a* is connected on a tab portion 44 of the connection terminal 25*a* for electrically connecting with an external circuit by the spot welding method. Similarly, the outer surface of the connection bridge 41 of the spring member 28*b* is connected to a tab portion 44 of the connection terminal 25*b* for electrically connecting with the external circuit by the spot welding method. Each of a pair of connection terminals 25*a* and 25*b* comprises a pin mounting portion 45 for mounting a pin-shaped connection terminal (not shown) of the compressor therein. A tab-shaped connection terminal 46 is integrally connected to the pin mounting portion 45 in the vertical direction or the longitudinal direction of the connection terminal 46, and the tab portion 44 is integrally formed with the pin mounting portion 45 and the connection terminal 46. Tab portion 44 is connected to a connection portion positioned between the pin mounting portion 45 and the connection terminal 46 so as to project in a direction approximately perpendicular to the longitudinal direction of the pin mounting portion 45 and the connection terminal 46. It is to be noted that, as shown in FIGS. 4 and 5, each tab portion 44 is folded along a projection surface 47*a* of a projection 47 which is formed in the center of the opposing inner wall of the lower case 32 so as to project from the inner wall thereof, as shown in FIG. 3.

The pin mounting portion 45 of the connection terminal 25*a* is mounted into a mounting portion 49*a* (FIG. 3) of a space which is formed between the inner wall of the lower case 32 and a fixing wall 48a for fixing the pin mounting portion 45 which is formed in the lower case 32. Similarly, the pin mounting portion 45 of another connection terminal 25*b* is mounted into another mounting portion 49*b* of a space which is formed between the inner wall of the lower case 32 and another fixing wall 48*b* for fixing the pin mounting portion 45 which is formed in the lower case 32. In the bottom surface of the lower case 32, there are formed insertion holes 51*a* and 51*b* (FIG. 1) for passing the pin-shaped connection terminals of the compressor therethrough in a direction of the thickness of the bottom surface thereof from the outside of the lower case 32 to the inside thereof so as to be opposite to the connection terminals 25*a* and 25*b*, respectively.

Further, each of the tab-shaped connection terminals 46 of the connection terminals 25*a* and 25*b* is inserted into a hole 52 which is formed in the flange portion 51 of the upper case 31 in the direction of the thickness of the flange portion 51 so as to project to the outside of the upper case 31.

In the thermistor device 21 constructed as described above, since the PTC thermistor 22 is supported in the outer packaging case 23 by the supporting member 24, it is necessary for respective spring pieces 38 of a pair of spring member 28*a* and 28*b* to be elastically in contact with the electrode films 27*a* and 27*b*. This is so that the electrode films 27*a* and 27*b*are electrically connected to the connection terminals 25*a* and 25*b*, respectively.

The thickness and the width of each spring piece 38 is set so as to be melted and cut or be fused when the temperature of the PTC thermistor 22 becomes higher than the predetermined threshold temperature, namely when the current flowing in the PTC thermistor 22 becomes larger than a predetermined threshold current. Therefore, when the current larger than the above predetermined threshold current flows in the PTC thermistor 22 through respective spring pieces 38, respective spring pieces 38 are easily melted and cut or are fused so as to be electrically opened. Accordingly, the outer packaging case 23 can be certainly prevented from being thermally broken.

The results of the experiment performed by the present inventor will be described below.

Figure 9:
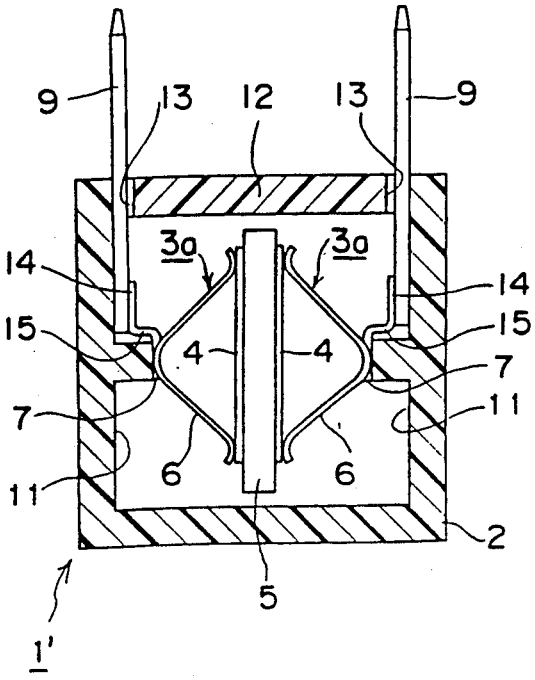
Fig. 9 PRIOR ART
FIG. 9 is a longitudinal cross sectional view of another conventional thermistor device comprising a PTC thermistor.
Figure 10:
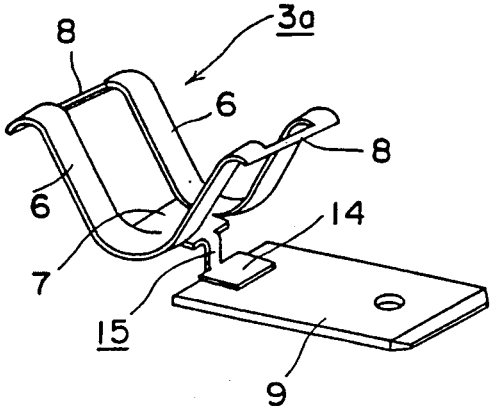
Fig. 10 PRIOR ART
FIG. 10 is a perspective view of a spring member and a connection terminal of the thermistor device shown in FIG. 9.

For the experiment, the present inventors prepared four samples A to D of the thermistor devices 21 shown in FIG. 1, comprising the spring members 28*a* and 28*b* and the connection terminals 25*a* and 25*b* shown in FIGS. 4 and 5. Further, as a comparative example, the present inventors prepared plural sample E of the thermistor device 1' shown in FIGS. 9 and 10.

Each of the samples A to E has the PTC thermistor 22 or 5, each thaving a diameter of 20 mm, a thickness of 2.5 mm, a resistance of 4.7 Ω at a temperature of 25° C., and a Curie temperature of 130° C. Each spring piece 38 of sample A has a thickness of 0.25 mm or more and a width of 2.0 mm or more. Each spring piece 38 of sample B has a thickness equal to or larger than 0.20 mm and smaller than 0.25 mm and a width equal to or larger than 1.5 mm and smaller than 2.0 mm. Each spring piece 38 of sample C has a thickness equal to or larger than 0.15 mm and smaller than 0.20 mm and a width equal to or larger than 1.5 mm and smaller than 2.0 mm. Each spring piece 38 of sample D has a thickness smaller than 0.15 mm and a width smaller than 1.5 mm. The connection portion 15 of sample E has a thickness in the range from 0.30 mm to 0.40 mm and a width of in the range from 1.0 mm to 2.0 mm.

Figure 6:
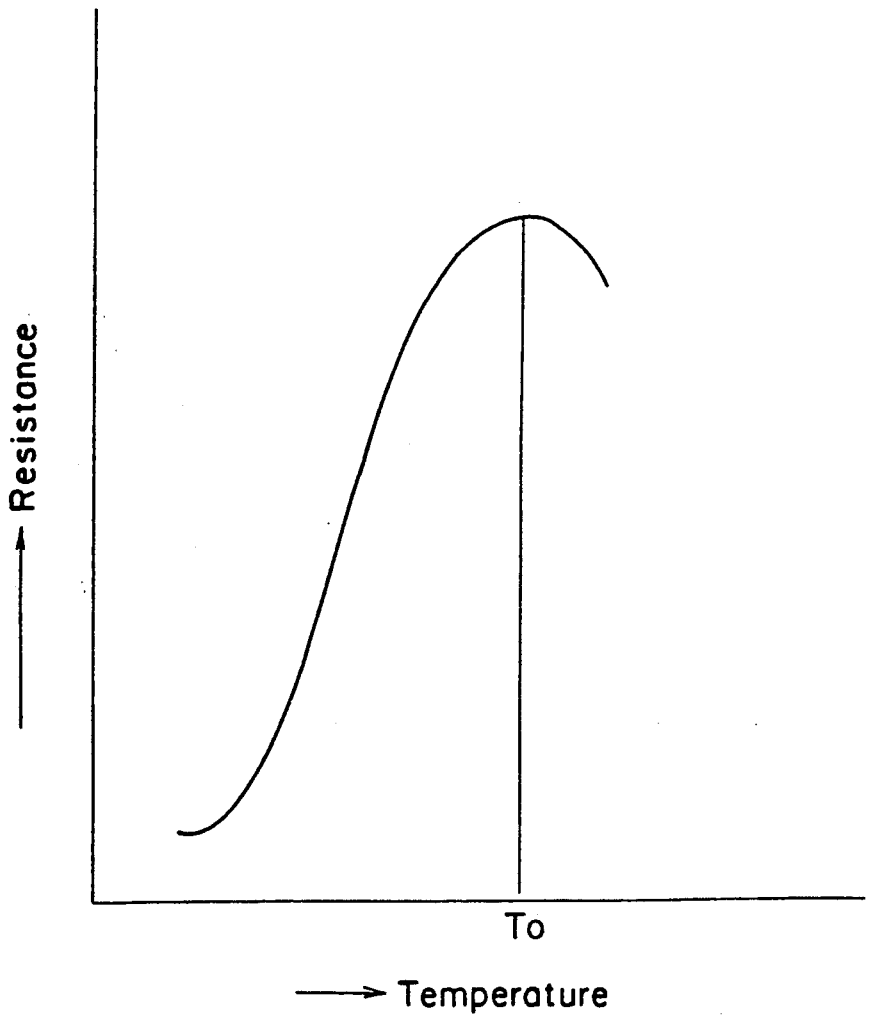
FIG. 6 is a graph showing a resistance characteristic as a function of the temperature of the PTC thermistor shown FIG. 1.
Figure 7:
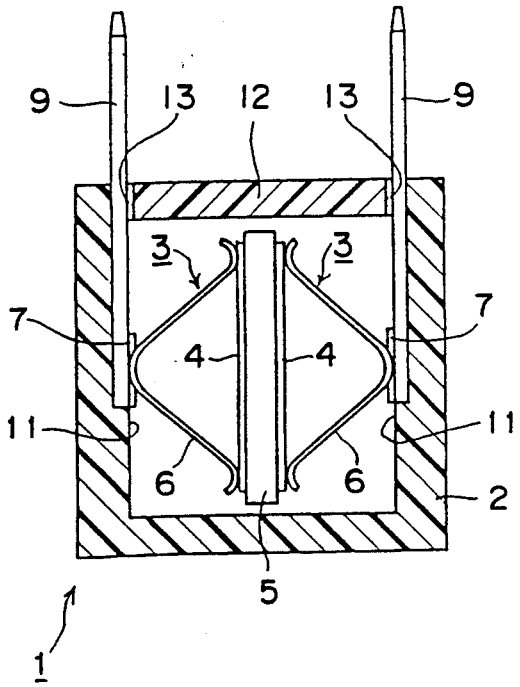
Fig. 7 PRIOR ART
FIG. 7 is a longitudinal cross sectional view of a conventional thermistor device comprising a PTC thermistor.
Figure 8:
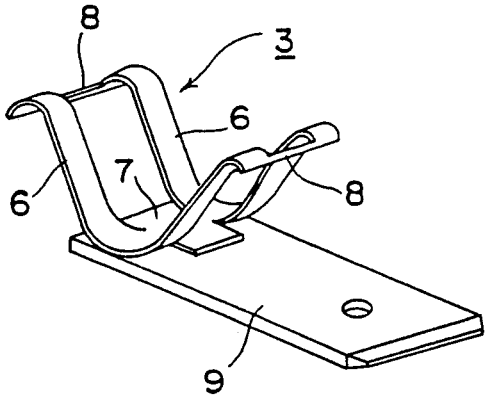
Fig. 8 PRIOR ART
FIG. 8 is a perspective view of a spring member and a connection terminal of the thermistor device shown in FIG. 7.

In the experiment, an alternate-current voltage of 180 V was applied to the PTC thermistor 22 or 5 of each of the samples A to E so that the PTC thermistor 22 or 5 operates in an area of a negative resistance temperature coefficient or at a temperature larger than a predetermined threshold temperature $T_0$ as shown in FIG. 6, and then, the PTC thermistor 22 or 5 runs abnormally hot. Thereafter, the thermal breakage coefficient (%) of the outer packaging case 23 or 2 of each of the samples A to E was measured.

Table 1 shows the results of the above measurement of the experiment.

As is apparent from Table 1, in the samples B to D having the spring pieces 38, each of which has a thickness smaller than 0.25 mm and a width smaller than 2.0 mm, there was obtained a thermal breakage coefficient of 50% or less of the outer packaging case 23. Accordingly, a width of each spring piece 38 is preferably set at a value smaller than 0.25 mm, and a thickness of each spring piece 38 is preferably set at a value smaller than 2.0 mm.

In the preferred embodiment, the present invention is applied to the thermistor device 21 having the PTC thermistor 22 which is used in the non-contact type starter of the compressor of the refrigerator. The present invention can be applied to the other electronic devices each electronic device having an electronic element in which a large current may flow in an abnormal state, such as an electronic device used in a magnetic eraser circuit.

Figure 11:
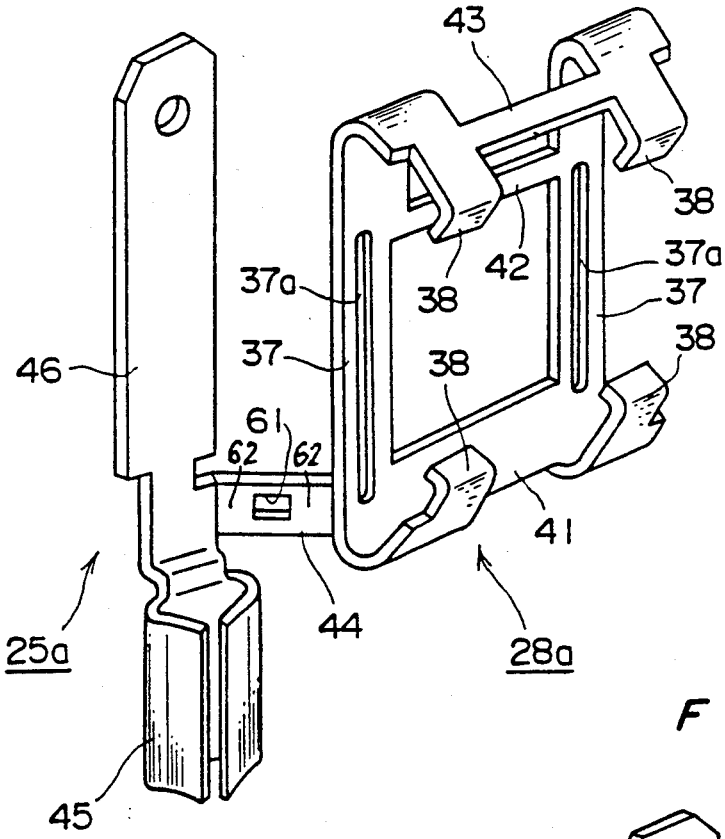
FIG. 11 is a perspective view of a connection terminal of in a modification of the preferred embodiment and the spring member fixed thereon.
Figure 12:
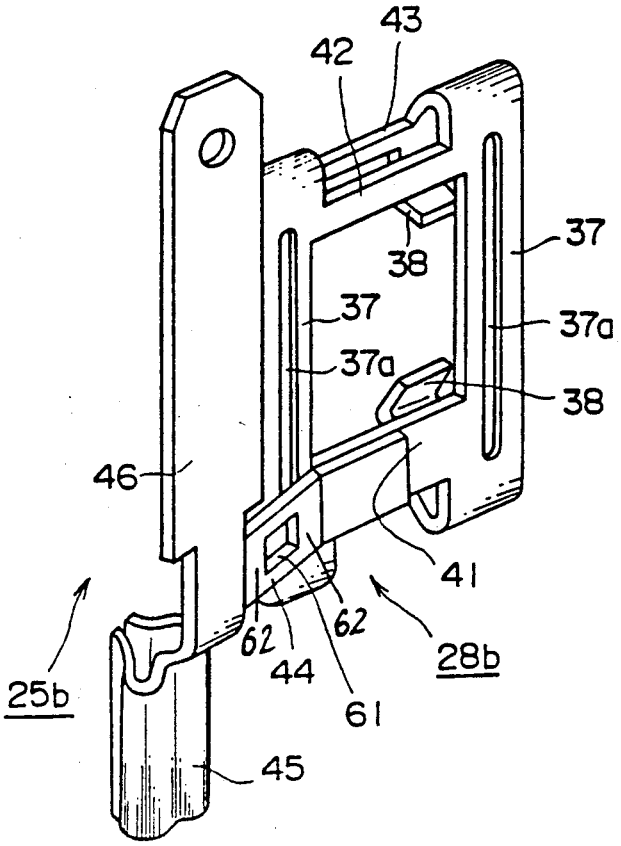
FIG. 12 is a perspective view of another connection terminal of in a modification of the preferred embodiment and another spring member fixed thereon.

Further, as shown in FIGS. 11 and 12, a window-shaped rectangular cut portion 61 may be formed in the center of tab portion 44 of each of the connection terminals **25*a* and 25*b* so as to form a low thermal conductive portion having a section smaller than that of the area 64 of the tab portion 44 without the cut portion 61. In this case, in the above-mentioned abnormal state of the PTC thermistor 22, a thermal conduction to be transferred from the spring members 28*a* and 28*b* to the connection terminals 25*a* and 25*b* is prevented from occurring, and then, respective spring pieces 38 of the spring members 28*a* and 28*b*** can be certainly melted and cut or fused.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

TABLE 1

| Sample | Thickness (mm) | Width (mm) | Thermal breakage coefficient (%) |
|---|---|---|---|
| A | 0.25 or more | 2.0 or more | 80 |
| B | 0.20 to 0.25 | 1.5 to 2.0 | 50 |
| C | 0.15 to 0.20 | 1.5 to 2.0 | 10 |
| D | 0.15 or less | 1.5 or less | less than 5 |
| E | 0.30 to 0.40 | 1.0 to 2.0 | 90 |

(Notes) In the samples A to D, the above "Thickness" means the thickness of each of the spring pieces 38, and the above "Width" means the width thereof. On the other hand, in the samples E of the comparative example, the above "Thickness" means the thickness of the connection portion 15, and the above "Width" means the width thereof.

What is claimed is:

1. An electronic device comprising:

a plate-shaped electronic element having electrode film formed on main surfaces thereof;

spring members elastically supporting said electronic element therebetween in an electrically insulating case so as to be respectively in contact with said electrode films of said electronic element, each spring member being made of an elastic plate metal material; and connection terminals for electrically connecting said spring members with external circuits, respectively, said connection terminals being fixed in said case and being electrically connected with said spring members, respectively;

each of said spring members comprising:

supporting plates opposing said electrode films of said electronic element and fixed directly to said case, each of said supporting plates having a predetermined longitudinal length and a predetermined width; and spring pieces rsepectively in contact with said electrode films of said electronic element at contact points thereof, each of said spring pieces being formed integrally with said supporting plate so as to be extended toward said electrode film of said electronic element, from an attachment point at one end of said supporting plate in the longitudinal direction thereof, toward said contact point, and folded by a predetermined angle at said contact point, and further extended toward said supporting plate from said contact point without contact with said supporting plate;

each of said spring pieces having a predetermined thickness and a predetermined width between said attachment point and said contact point so as to be cut when a current flowing in said spring pieces through said electronic element becomes larger than a predetermined threshold current.

2. The electronic device as claimed in claim 1, further comprising tab members for connecting said connection terminals with said spring members, respectively, each of said tab members having a cut portion formed therein.

3. The electronic device as claimed in claim 1, wherein each of said spring pieces has a predetermined thickness smaller than 0.25 mm and a predetermined width smaller than 2.0 mm.

4. The electronic device as claimed in claim 1, wherein said electronic element is a thermistor having a positive temperature coefficient.

5. The electronic device as claimed in claim 3, further comprising tab members for connecting said connection terminals with said spring members, respectively, each of said tab members having a cut portion formed therein.

6. The electronic device as claimed in claim 4, further comprising tab members for connecting said connection terminals with said spring members, respectively, each of said tab members having a cut portion formed therein.

7. An electronic device in accordance with claim 1, wherein each of said supporting plates comprises rib means for increasing a rigidity of said supporting plates, said rib means comprising at least one rib having a longitudinal length in a direciton perpendicular to the direction of said predetermined width of each of said supporting plates.

8. An electronic device according to cliam 1, wherein each of said electronic devices comprises a support member on each of the opposing sides, perpendicular to said main surfaces, of said electronic element for providing additional support to said electronic element, the support member comprising a disk plate of an electrically insulating, heatproof material, said disk plate having an outer peripheral end making contact with said insulating case, and an inner side of the disk plate containing hole means for mounting a portion of said electronic element to the disk plate.

9. An electronic device according to claim 8, wherein the material of each said support member is mica.

10. A method of elastically supporting an electronic element and protecting said electronic element from excessive current flow therethrough, comprising the steps of:

(a) mounting an electronic element having two opposing main surfaces between two spring members each made of an elastic plate metal material and each providing an electrical connection with a respective main surface of the electronic element;

(b) providing respective connection termainls electrically connected to each of two said spring members; and (c) mounting the electronic element, the two spring members and the connection terminals in an outer packaging case;

(d) wherein each spring member extends toward said electronic element from a supporting plate integrally formed with said spring member, each of said supporting plates being fixed directly to said case, and each spring member having predetermined dimensions at a location between said supporting plate and said electronic element, such that the spring member is automatically cut when a predetermined current flow therethrough is exceeded.

11. A method according to claim 10, wherein the material of each said support member is mica.

12. The method of claim 10, wherein said spring members are cut by said current at a location immediately adjacent said electronic element.

13. A method according to claim 10, wherein said electronic element is a thermistor.

14. A support and overcurrent protector for a plate-shaped electronic element, comprising:

at least one spring member for elastically supporting said electronic element in an electrically insulating case with said spring member in electrical contact with said electronic element at a contact point, said spring member being made of an elastic plate metal material, said spring member extending toward said electronic element from a support plate which is in direct contact with said case; and connection means for electrically connecting said spring member with an external circuit, said connection means being fixed in said case and being electrically connected with said spring member via said support plate;

said spring member comprising a fuse portion at a location between said contact point and said support plate, said fuse portion having predetermined dimensions, so as to be cut when a current flowing in said spring member through said electronic element becomes larger than a predetermined threshold current.

15. A support and overcurrent protector for a plate-shaped electronic element, comprising:

spring members for elastically supporting said electronic element therebetween in an electrically insulating case so as to be respectively in contact with said electronic element, each spring member being made of an elastic plate metal material; and connection terminals for electrically connecting said spring members with external circuits, respectively, said connection terminals being fixed in said case and being electrically connected with said spring members, respectively;

each of said spring members comprising:

supporting plates opposing said electrode films of said electronic element and fixed directly tos aid case, each of said supporting plates having a predetermined longitudinal length and a predetermined width; and spring pieces being respectively in contact with said electrode films of said electronic element at contact points thereof, each of said spring pieces being formed integrally with said supporting plate so as to be extended toward said electronic element, from an attachment point at one end of said supporting plate in the longitudinal direction thereof, toward said contact point, and folded by a predetermined angle at said contact point, and further extended toward said supporting plate from said contact point without contact with said supporting plate;

each of said spring pieces having a predetermined thickness and a predetermined width between said attachment point and said contact point so as to be cut when a current flowing in said spring pieces through said electronic element becomes larger than a predetermined threshold current.

16. The electronic device as claimed in claim 1, wherein said spring pieces are cut by said current at a location immediately adjacent said electronic element.

17. The support and overcurrent protector as claimed in claim 14, wherein said spring member is cut by said current at a location immediately adjacent said electronic element.

18. The support and overcurrent as claimed in claim 15, wherein said spring pieces are cut by said current at a location immediately adjacent said electronic element.

* * * * *